United States Patent [19]

Mayer

[11] Patent Number: 4,553,387

[45] Date of Patent: Nov. 19, 1985

[54] SUPERCHARGED INTERNAL COMBUSTION ENGINE WITH EXHAUST PARTICULATES FILTER

[75] Inventor: Andreas Mayer, Niederrohrdorf, Switzerland

[73] Assignee: BBC Brown, Boveri & Company, Limited, Baden, Switzerland

[21] Appl. No.: 406,510

[22] Filed: Aug. 9, 1982

[30] Foreign Application Priority Data

Nov. 8, 1981 [CH] Switzerland ..... 5155/81

[51] Int. Cl.[4] ..... F01N 3/02

[52] U.S. Cl. ..... 60/274; 60/280; 60/285; 60/311; 123/559

[58] Field of Search ..... 123/559; 60/274, 285, 60/311, 280

[56] References Cited

U.S. PATENT DOCUMENTS

| | | | |
|---|---|---|---|
| 2,800,120 | 7/1957 | Jendrassik | 123/559 |
| 3,011,487 | 12/1961 | Berchtold | 123/559 |
| 3,180,330 | 4/1965 | Barnes | 123/559 |
| 3,951,626 | 4/1976 | Carey | 60/311 |
| 4,211,075 | 7/1980 | Ludecke | 60/285 |
| 4,329,162 | 5/1982 | Pitcher | 60/311 |

FOREIGN PATENT DOCUMENTS

| | | | |
|---|---|---|---|
| 44324 | 4/1977 | Japan | 60/280 |

*Primary Examiner*—Douglas Hart

*Attorney, Agent, or Firm*—Burns, Doane, Swecker & Mathis

[57] ABSTRACT

In order to limnit the exhaust particulate emission when supercharging a pressure wave machine-supercharged internal combustion engine, an exhaust particulates filter is arranged in the high-pressure part of the exhaust gas system ahead of the pressure wave machine.

By increasing the supply of fuel to the engine itself and/or briefly closing a charge air flap valve a recirculation flap valve and/or brief opening of a exhaust gas by-pass valve, the exhaust gas attains the combustion temperature of soot components deposited on the surface of the filter. These soot components are burned off, and the filter is automatically regenerated.

18 Claims, 4 Drawing Figures

SUPERCHARGED INTERNAL COMBUSTION ENGINE WITH EXHAUST PARTICULATES FILTER

BACKGROUND AND SUMMARY OF THE PRESENT INVENTION

The present invention generally concerns a device and a method for limiting exhaust particulate emission when supercharging internal combustion engines. More specifically, the present invention concerns a supercharged internal combustion engine provided with a pressure wave machine such as a turbocharger having a charge air flap valve and/or a recirculation flap valve and/or an exhaust gas by-pass valve, and exhaust gas conduits or elbows leading to an exhaust gas receiver.

Particulate emission from internal combustion engines has already been limited by law in some countries. Other countries will follow with more severe and restrictive implementation of regulations concerning the allowable limits for the emission of particulates in exhaust gases.

The particulate emission of internal combustion engines is essentially made up of the following components:

Suspended soot,

Hydrocarbon compounds and other organic substances adhering to the soot,

Sulfate compounds, and

Lead compounds (in the case of spark-ignition engines)

Reduction of the particulate emission from internal combustion engines by measures taken inside the internal combustion engine is not yet possible given the present state of the art, but advances have already been achieved in the field of influencing particulate emission by aftertreatment of the exhaust gas. Methods for the after-burning of suspended soot and unburned high-boiling hydrocarbons as well as soot removal by exhaust gas filtration are especially prominent here.

The Forschungsgesellschaft für Energietechnik und Verbrennungsmotoren mBH in Aachen West Germany has published a study by Dr. Herman Weltens entitled "Möglichkeiten zur Beeinflussung der Partikelemission von Dieselmotoren durch Abgasnachbehandlung (Possibilities for influencing the emission of particulates from diesel engines by aftertreatment of the exhaust gas"), on the occasion of a symposium in Esslingen West Germany on the 28th and 29th of Apr. 1980, which indicates the present state of the art.

On pages 15 and 16 of this publication in particular, attention is drawn to the fact that there is no certainty that the conditions required for spontaneous ignition and combustion of soot collected in the exhaust gas filter are reached sufficiently often in normal running conditions. It is thus proposed to oxidize the soot deposits intermittently with the aid of energy supplied from an external source. This external energy can be supplied by an open flame or by electric heating.

Without the aid of energy from an external source, the combustion of soot deposits on the surfaces of exhaust particulate filters is not possible with the methods known at the present time. This applies particularly to internal combustion engines which are supercharged by pressure wave machines. The only possibility here would be the insertion of exhaust particulate filters in the exhaust line downstream of the pressure wave machine.

However, small, low-pressure resistances are required in order to maintain low-pressure scavenging in the pressure wave machine at every operating point. When new, the pressure loss of an exhaust particulate filter is small and amounts to approximately 200 mm, water gage. The increase in the exhaust back pressure in the case of a blocked filter can in some circumstances lead to a breakdown of low pressure scavenging in the pressure wave machine and consequently to stalling of the engine.

Furthermore, the exhaust gas temperature downstream of the pressure wave machine is lower than, for instance, in the case of supercharging with a turbocharger, because of the proportion of scavenging air. The external energy supply for the combustion of the soot is greater when supercharging with a pressure wave machine.

One primary aim of the present invention is to remedy this problem. The present invention achieves the object of producing a device by which the particulate emission from internal combustion engines supercharged with pressure wave machines is limited to an optimum extent, by arranging an exhaust particulate filter in a high-pressure part of an exhaust gas system ahead of the pressure wave machine.

This arrangement of the exhaust particulate filter has the following advantages:

Saving of external energy;

Devices for the supply of external energy and soot combustion equipment for the combustion of soot deposits on the surfaces of the exhaust particulate filters by external energy are dispensed with;

Control equipment for initiating the ignition process of the external energy depending on the exhaust gas back pressure is also dispensed with;

The exhaust gas recirculation capability of the pressure wave machine itself is increased without the danger of fouling the rotor of the pressure wave machine;

After the ignition of the soot deposits the density of the charge air immediately increases again, the exhaust gas temperature decreases and the engine does not overheat;

Because the soot combustion reaction is exothermic, it continues undiminished in spite of a decreased exhaust gas temperature.

The filter is preferably arranged in the exhaust gas receiver itself. The advantage of this arrangement is apparent from the fact that the hot exhaust gases leaving the internal combustion engines can be utilized without losses for the combustion of the soot.

The filter is also preferably arranged in a segment separate from the exhaust gas receiver itself and immediately ahead of the pressure wave machine in the direction of exhaust gas flow and the filter is designed as an exchangeable constructional unit.

Thus the filter can be changed simply and rapidly.

The filter includes a monolithic, porous and heat-resistant core.

The particulates present in the exhaust gas impinge on the surface of the exhaust particulate filter and there agglomerate into larger particulates. The condition of the surface and the porosity of the material of construction of the exhaust particulate filter play a decisive role as regards the attachment and agglomeration processes of the soot particulates.

The core of the filter is surrounded by a fibrous, mat-like and heat-resistant covering.

The core of the filter together with the covering is arranged in a cylindrical carrier tube which is held at one end by the retaining ring provided in the exhaust gas receiver and at the other end by the retaining pin provided in the exhaust gas receiver.

Also, the cylindrical carrier tube is preferably secured between the flange of the exhaust gas receiver and the flange of the segment.

Thus, the core of the filter is rigidly held by the cylindrical carrier tube with intermediate positioning of the fibrous, mat-like covering and its position is accurately fixed in the axial and radial directions.

The carrier tube preferably includes a heat-resistant sheet metal. An elastic heat-resistant layer is arranged between the sheet metal and the solid jacket of the segment of the exhaust gas receiver.

In this way it is ensured that the carrier tube does not distort at relatively high temperatures, that it exhibits a high resistance to oxidation and that possible vibrations from the machine are damped by the elastic heat-resistant layer and thus not transmitted directly to the core of the filter.

The monolithic porous core of the filter preferably includes either a ceramic material with a high degree of stability with respect to temperature change or steel wool. With both these materials, optimum filter properties are achieved at relatively high temperatures when taking temperature variation into consideration.

In a method for operating the device, additional fuel is fed to the internal combustion engine in order to raise the exhaust gas temperature ahead of the particulates filter.

The charge air flap valve in the charge air line may be briefly closed in order to raise the exhaust gas temperature ahead of the filter and is then again operated normally after regeneration of the filter has taken place.

Alternatively, the recirculation flap valve in the fresh air suction line of the pressure wave machine may be briefly closed in order to raise the exhaust gas temperature ahead of the filter and may be operated normally again after regeneration of the filter has taken place.

Also alternatively, the exhaust gas temperature ahead of the filter may be raised by briefly opening the exhaust gas by-pass valve and then operating it again normally after regeneration of the filter has taken place.

The exhaust gas by-pass valve is arranged in the by-pass between the exhaust housing and the exhaust line of the pressure wave machine. The three operational steps outlined immediately above are alternatives. Thus a range of operating possibilities is available for raising the exhaust gas temperature ahead of the filter and burning off soot deposits on the surface of the filter.

BRIEF DESCRIPTION OF THE DRAWINGS

The present invention is illustrated in more detail below by the exemplary embodiments in the drawings in which like members bear like reference numerals and in which.

DETAILED DESCRIPTION OF THE PREFERRED EMBODIMENTS

Figure 1:
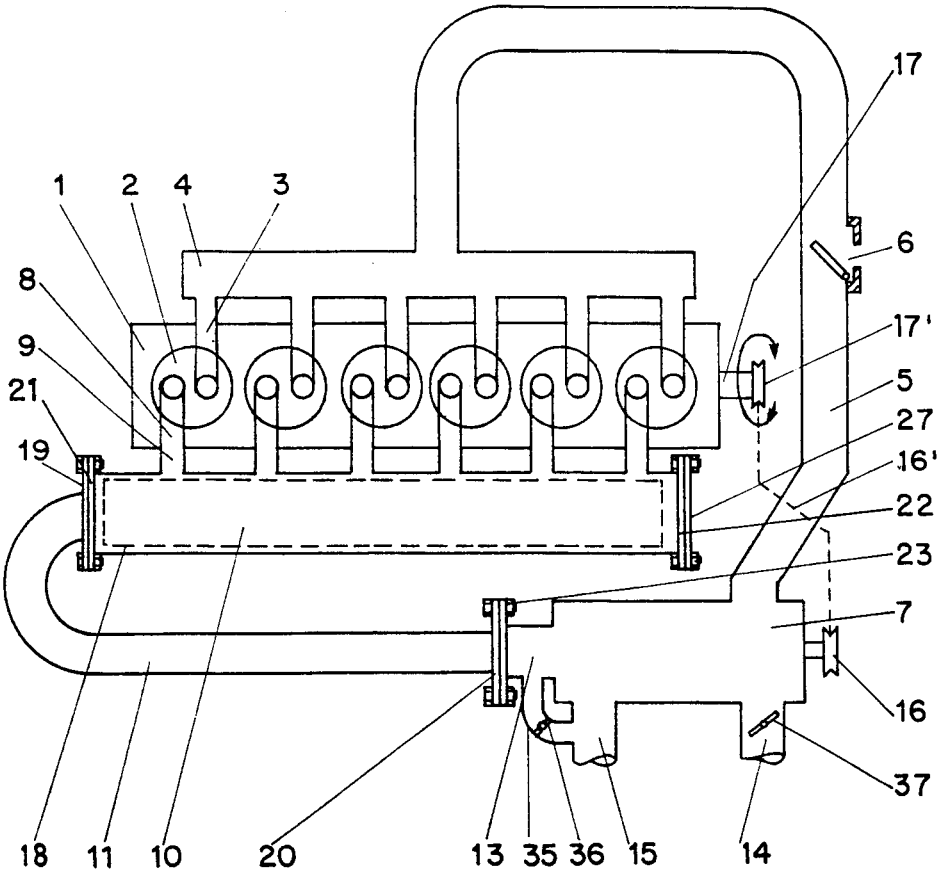
FIG. 1 is a schematic view of a first preferred embodiment of an exhaust particulate filter arrangement in the supercharging of an internal combustion engine by a pressure wave machine.

With reference now to FIG. 1, a cylinder head 1 of an internal combustion engine has six cylinders 2. In the cylinder head 1 an inlet/suction channel 3 is arranged for each cylinder, with the channels 3 leading into a manifold 4. The manifold 4 is connected to a pressure wave machine such as a supercharger or turbocharger 7 by a charge air line 5, in which is situated a charge air flap valve 6.

An exhaust gas channel 8 is also arranged for each cylinder in the cylinder head 1; and exhaust gas conduits or elbows 9 are attached to each of the exhaust gas channels 8 and lead into an exhaust gas receiver 10. An exhaust housing 13 of the pressure wave machine 7 is connected to the exhaust gas receiver 10 by a connecting piece 11 in a manner known per se. As already mentioned, the charge air line 5 leads into the pressure wave machine 7 and a fresh air suction line 14, with a recirculation flap valve 37, and an exhaust line 15 are also attached to the pressure wave machine 7. The exhaust gas by-pass valve 36 is situated in a by-pass 35 between the exhaust housing 13 and the exhaust line 15. The mode of operation of the charge air flap valve 6, the recirculation flap valve 37 and the exhaust gas by-pass valve 36 is explained in more detail in connection with the mode of operation of the particulate exhaust filter 18 provided in the exhaust receiver 10 during running operation, following the description of FIG. 4. The pressure wave machine 7 is driven by the engine shaft 17 via a pulley 16. For reasons of improved representation in the drawing the connection of the V-belt 16' between the pulley 16 and the engine shaft 17 or engine pulley 17' is only shown schematically.

In this first preferred embodiment the exhaust particulate filter 18 is arranged in the exhaust gas receiver 10 itself. The particulate filter 18 is only indicated by dashed lines in FIG. 1, but is represented in detail and explained in FIG. 3.

For the purpose of simpler handling and better accessibility when changing the filter 18 the end plate 27 is, on one side, removably joined to the flange 22 of the exhaust gas receiver 10 by a threaded bolt 29, a washer 30 and a nut 31. On the other side, the flange 21 of the exhaust gas receiver 10 is likewise removably joined to the flange 19 of the connecting piece 11 by a bolted connection.

The connecting piece 11, in turn, connects the exhaust gas receiver 10 to the exhaust housing 13 of the pressure wave machine and is arranged so as to be removable by the flange connection 19, 21 and the flange connection 20, 23.

Figure 2:
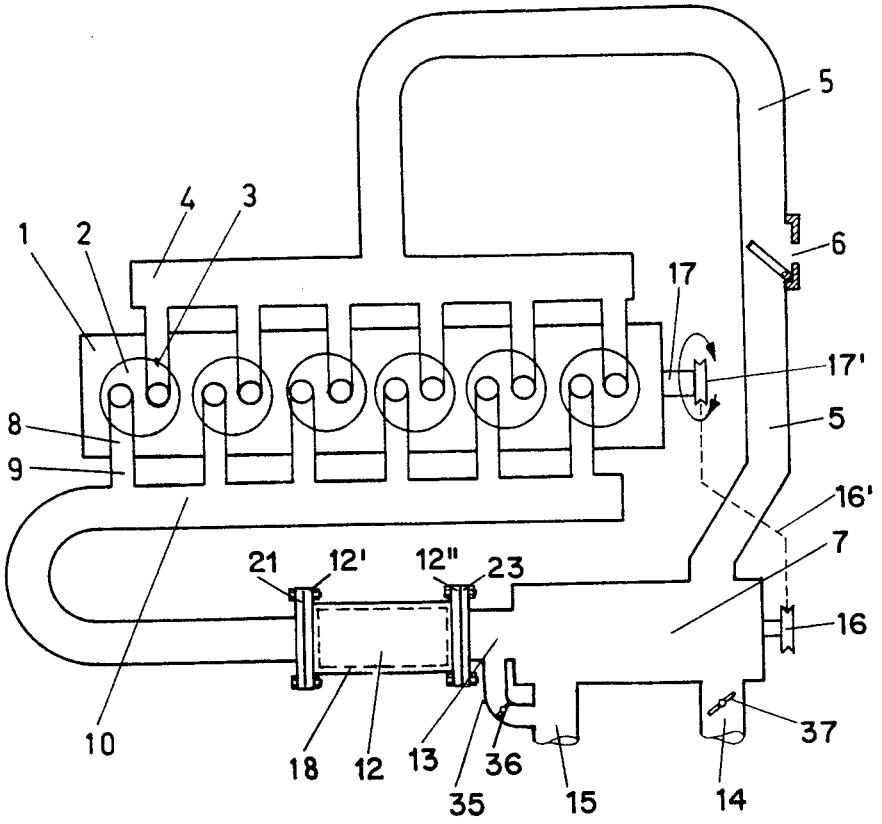
FIG. 2 is a schematic representation of a second preferred embodiment of an exhaust particulate filter arrangement in the supercharging of an internal combustion engine by a pressure wave machine.

FIG. 2 illustrates a schematic representation of a second preferred embodiment of the exhaust particulates filter arrangement. Here the filter 18 is arranged in a segment 12 which is separate from the exhaust gas receiver 10 itself with the segment being situated immediately ahead of the pressure wave machine 7.

In the preferred embodiment according to FIG. 2, the exhaust gas receiver 10 has a smaller diameter in comparison with the first preferred embodiment (FIG. 1) and extends up to the segment 12. There is no connecting piece 11 in this arrangement.

For the purpose of simple handling and better accessibility when changing the filter 18, the segment 12 is also arranged so as to be removable. On one side a first flange 12′ of the segment 12 is joined removably by a bolted connection to the flange 21 of the exhaust gas receiver 10. On the other side, a second flange 12″ is likewise removably joined to the flange 23 of the exhaust housing 13 of the pressure wave machine 7 by a bolted connection.

Figure 3:
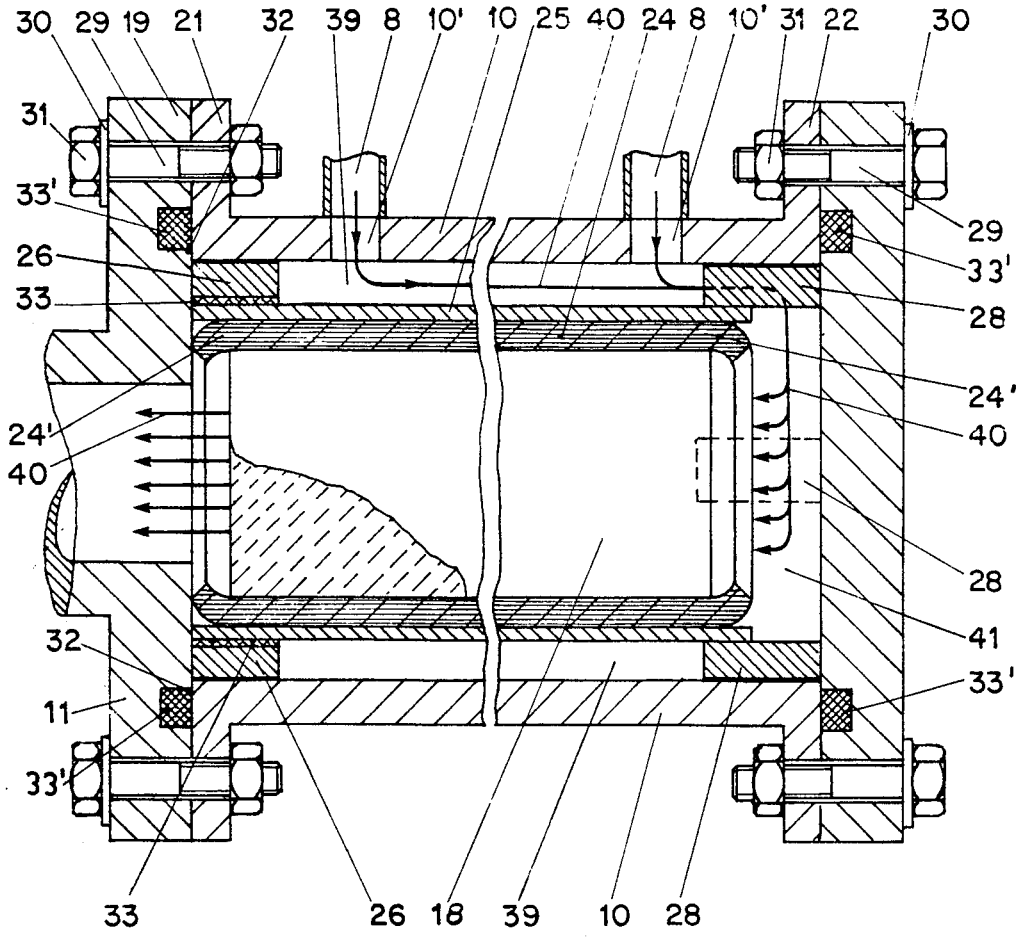
FIG. 3 is a cross-sectional view of an exhaust particulate filter arrangement according to the exemplary embodiment of the first preferred embodiment of FIG. 1.

In FIG. 3, which uses the same reference numerals as FIG. 1, a section through the exhaust particulates filter arrangement according to the first preferred embodiment (FIG. 1) is illustrated. For the purpose of improved representation, however, only the ends of the exhaust gas receiver and a part of the exhaust gas receiver 10 are shown, as is a part of the filter 18.

The filter 18 includes a monolithic, porous, heat-resistant and cylinder-shaped core piece of ceramic material of the type described for example in SAE Paper No. 810114 of Feb. 23, 1981 titled "Cellular Ceramic Diesel Particulate Filters" by John S. Howitt et al. The core piece is provided with a fibrous and heat resistant mat-like covering 24 of ceramic or mineral fiber. Respective ends 24′ of the mat-like covering 24 project beyond the cylinder-shaped filter 18 in the axial direction and are inclined inwards towards the axis, the position of the filter 18 being thus fixed in the longitudinal direction. The filter 18 together with the covering 24 is secured in a carrier tube 25 made a heat-resistant sheet metal, which encloses the filter 18 together with the covering 24 under compressive pressure. The ends of the carrier tube 25 are welded up along a generating line. The ring-shaped exhaust gas feed space 39 is situated between the carrier tube 25 and the solid jacket of the exhaust gas receiver 10. The exhaust gas flows from the exhaust gas channels 8 into the exhaust gas feed space 39 and from there into the filter prechamber 41 in accordance with the direction of the arrows with the reference number 40. The exhaust gas feed space 39 and the filter prechamber 41 are connected with each other. After passing through the filter 18, the exhaust gas flows into the connecting piece 11 and from there to the exhaust housing 13 of the pressure wave machine 7.

For securing the carrier tube 25, a retaining ring 26 is arranged at the downstream end of the exhaust gas receiver 10 and at least four retaining pins 28 are arranged, concentrically in each case, at the other end of the exhaust gas receiver 10. An asbestos gasket 33 is situated between the retaining ring 26 and the carrier tube 25 in order to prevent the exhaust gas from getting directly into the connecting piece 11 by-passing the filter 18. A plurality of further asbestos gaskets 33′ seal the filter off from its surroundings.

Figure 4:
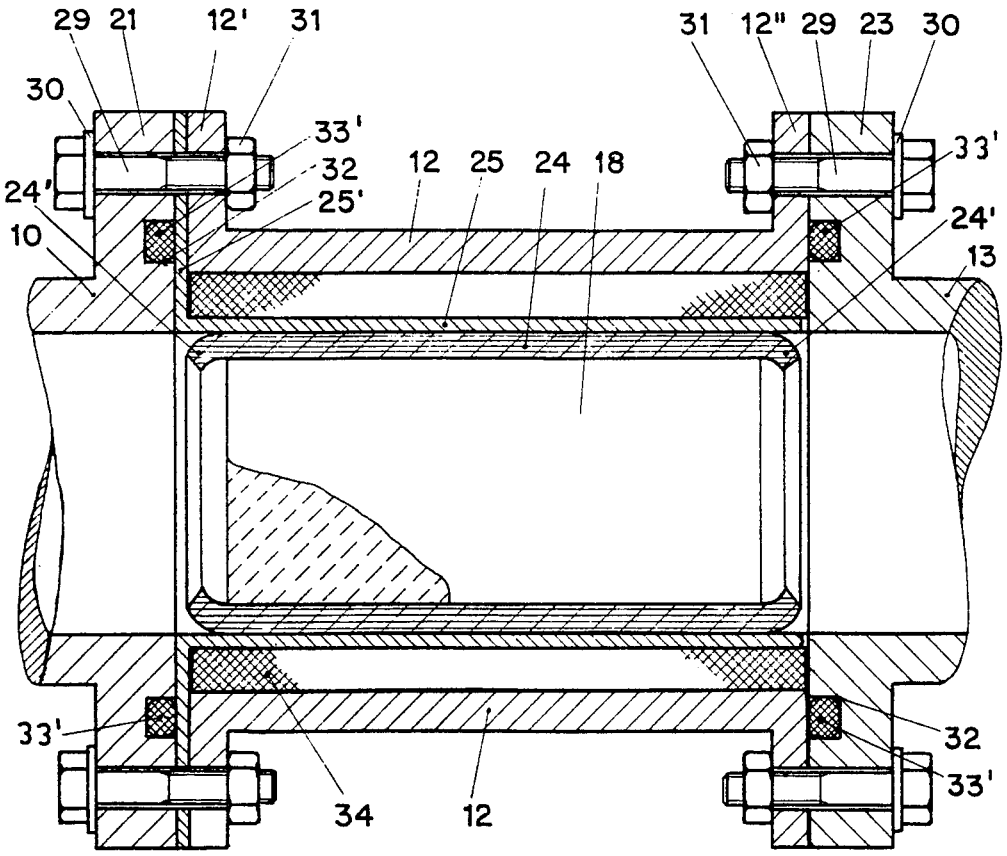
FIG. 4 is a cross-sectional view of an exhaust particulate filter arrangement according to the second preferred embodiment of the present invention as illustrated in FIG. 2.

In FIG. 4 a section through the particulate exhaust filter arrangement according to the preferred embodiment of FIG. 2 is illustrated. The construction of the filter 18 is the same as has been described in detail in FIG. 3. A carrier tube flange 25′ is provided at one end of the carrier tube 25, which flange is clamped in between the flange 21 of the exhaust gas receiver 10 and the flange 12′ of the segment 12 and is secured by bolted connections 29, 30 and 31. Between the carrier tube 25 and the solid jacket of the segment 12 there is an elastic, heat-resistant layer 34 of wire mesh. The securing of the carrier tube 25 on one side and its covering with the elastic, heat-resistant layer 34 were chosen so as to damp possible vibrations of the machine and to attenuate more rapidly vibrations which have already been transmitted to the carrier tube 25. In addition, adequate account must be taken of the differential thermal expansion of the various materials, as produced by thermal influences. If the carrier tube 25 were to be fixed on both sides then thermal stresses would eventually lead to the destruction of the securing arrangement of the carrier tube 25. The flange 12″ of the segment 12 is joined to the flange 23 of the exhaust gas chamber 13 of the pressure wave machine 7 by bolted connections 29, 30 and with a gasket 33′ being interposed.

The mode of operation of the filter 18 during running operation will be described below.

If, during partial loading, there is a blockage of the filter 18, then the pressure loss of the filter 18 produces, in the first instance, interference with the charge cycle of the motor, which leads to a reduction in performance. The driver will make up for the performance loss by using more fuel; this causes a pronounced rise in gas temperature. If the driver demands sufficient performance from the vehicle, then this leads automatically to the burning-off of the soot. The combustion temperature of the soot is about 650° C.

A temperature surge can however also arise through brief operation of the charge air flap valve 6, the exhaust gas by-pass valve 36 or the recirculation flap valve 37. On brief closure of the charge air flap valve 6 or the recirculation flap valve 37 or on brief opening of the exhaust gas by-pass valve 36, the charge air density and thus the air excess is briefly decreased, which increases the gas temperature at constant fuel injection rate.

The pressure wave machine 7 tolerates the high temperature peaks because the rotor is scavenged with fresh air. The exhaust gas recirculation capacity of the pressure wave machine 7 itself can be raised by temperature surges, without danger of fouling the rotor.

Various modifications and alterations to the above-described specific embodiments will be apparent to those skilled in the art. Accordingly, the foregoing detailed description should be considered exemplary in nature and not as limiting to the scope and spirit of the invention as set forth in the appended claims.

What is claimed is:

1. A device for limiting exhaust particulate emission when supercharging internal combustion engines, comprising:

a pressure wave machine;

an air suction line means for delivering air to said pressure wave machine;

a charge air line means for delivering charged air from said pressure wave machine to said internal combustion engine;

a plurality of exhaust gas conduits leading from a cylinder head of an internal combustion engine to an exhaust gas system, said exhaust gas system including a high pressure portion communicating said cylinder head with said pressure wave machine and a low pressure portion downstream of said pressure wave machine, the high pressure portion including an exhaust gas receiver;

a briefly closable recirculation valve in said air suction line; and an exhaust particulate filter arranged in the high pressure portion of said exhaust gas system upstream of the pressure wave machine whereby the brief closing of the recirculation valve in said air suction line briefly raises the temperature of the exhaust gas entering said filter so as to ignite and burn particulates collected at said particulate filter.

2. The device of claim 1, wherein said filter is arranged in the exhaust gas receiver itself.

3. The device of claim 1, wherein said filter is arranged in an exhaust gas system segment separate from the exhaust gas receiver itself and immediately ahead of the pressure wave machine in the direction of exhaust gas flow.

4. The device of claim 1, wherein said filter is a removable unit.

5. The device of claim 4, wherein the filter includes a monolithic, porous and heat-resistant core.

6. The device of claim 5, wherein said core of the filter is surrounded by a fibrous, mat-like and heat-resistant covering.

7. The device of claim 6, wherein said core of the filter together with said covering are arranged in a cylindrical carrier tube which is held at one end by a retaining ring provided in the exhaust gas receiver and at the other end is held by a plurality of retaining pins provided in the exhaust gas receiver.

8. The device of claim 6, wherein said core of the filter together with said covering are arranged in a cylindrical carrier tube which is secured between a flange of the exhaust gas receiver and a flange of an exhaust gas system segment.

9. The device of claim 8, wherein the carrier tube includes a heat-resistant sheet metal layer.

10. The device of claim 8, wherein an elastic, heat-resistant layer is arranged between said carrier tube and a solid jacket of said segment of the exhaust gas system.

11. The device of claim 10, wherein said elastic, heat-resistant layer is formed by an elastic, heat-resistant wire mesh.

12. The device of claim 5, wherein said monolithic porous core of the filter is formed by a ceramic material having a high degree of stability with respect to temperature change.

13. The device of claim 5, wherein the monolithic porous core of the filter is formed by steel wool.

14. The device as claimed in claim 1 wherein said device further comprises a charge air flap on said charge air line, said charge air flap being briefly closable to raise the temperature of exhaust gas in the high pressure portion of the exhaust gas system.

15. The device as claimed in claim 1 wherein said device further comprises a by-pass communicating said high pressure portion with said low pressure portion and an exhaust by-pass valve in said by-pass, said by-pass valve being briefly openable to raise the temperature of exhaust gas in the high pressure portion of said exhaust gas system.

16. A method for limiting exhaust particulates emission from an internal combustion engine comprising the steps of:

mechanically driving a pressure wave machine from said internal combustion engine;

inducting air into said pressure wave machine through an air suction line having a recirculation valve therein;

discharging the air from said pressure wave machine in a pressurized state;

conveying the pressurized air from said pressure wave machine to an intake manifold of said internal combustion engine through a charge air line;

conveying exhaust products from said internal combustion engine to an exhaust housing of said pressure wave machine through a high pressure exhaust line;

removing exhaust products from said pressure wave machine through a low pressure exhaust line;

collecting particulates from the engine exhaust in a filter in said high pressure exhaust line upstream of the pressure wave machine; and briefly reducing the amount of said pressurized air conveyed to said intake manifold by briefly closing said recirculation valve to briefly raise the temperature of the exhaust gas entering said filter to thereby ignite and burn at least a portion of collected particulates.

17. The method of claim 16 wherein said briefly reducing step includes briefly closing a charge air flap valve in said charge air line.

18. The method of claim 16 wherein said briefly reducing step includes briefly opening an exhaust gas by-pass valve in a by-pass communicating said high pressure exhaust line with said low pressure exhaust line.

* * * * *